US005831372A

United States Patent [19]

Seino et al.

[11] Patent Number: 5,831,372

[45] Date of Patent: Nov. 3, 1998

[54] CATHODE RAY TUBE WITH SUPPORTING MEMBERS EACH HAVING A FIRST AND SECOND SUPPORT PORTION FOR IMPROVED BEARING OF ATMOSPHERIC PRESSURE BETWEEN THE FACEPLATE AND THE REARPLATE

[75] Inventors: Kazuyuki Seino; Takashi Nishimura; Masakatu Arai, all of Fukaya; Hitoshi Nagai, Saitama-ken; Eiji Kamohara, Fukaya, all of Japan

[73] Assignee: Kabushiki Kaisha Toshiba, Kawasaki, Japan

[21] Appl. No.: 708,197

[22] Filed: Sep. 6, 1996

[30] Foreign Application Priority Data

Sep. 8, 1995 [JP] Japan ..... 7-231165

[51] Int. Cl.[6] ..... H01J 31/20

[52] U.S. Cl. ..... 313/2.1; 313/408; 313/496; 313/402

[58] Field of Search ..... 313/2.1, 495, 496, 313/497, 402, 408, 422, 292, 476, 482

[56] References Cited

U.S. PATENT DOCUMENTS 5,287,034 2/1994 Kamohara et al. .

5,365,142 11/1994 Nishimura et al. .

FOREIGN PATENT DOCUMENTS 0 471 359 2/1992 European Pat. Off. .
0 548 467 6/1993 European Pat. Off. .
0 634 775 1/1995 European Pat. Off. .

*Primary Examiner*—Sandra L. O'Shea
*Assistant Examiner*—Joseph Williams
*Attorney, Agent, or Firm*—Pillsbury Madison & Sutro LLP

[57] ABSTRACT

A vacuum envelope includes a flat faceplate and a flat rear plate opposed to the faceplate. A phosphor screen is formed on an inner surface of the faceplate. A plurality of support members are located between the faceplate and the rear plate and bear atmospheric pressure acting on the faceplate and the rear plate. Each support member has first and second support portions. The first support portion is set up on the rear plate and has a proximal end face intimately in contact with the inner surface of the rear plate and a bearing surface substantially parallel to the rear plate. The second support portion is provided between the bearing surface of the first support portion and the faceplate, and has a distal end abutting against a predetermined position on the inner surface of the faceplate and a proximal end portion intimately in contact with the bearing surface of the first support portion.

14 Claims, 8 Drawing Sheets

CATHODE RAY TUBE WITH SUPPORTING MEMBERS EACH HAVING A FIRST AND SECOND SUPPORT PORTION FOR IMPROVED BEARING OF ATMOSPHERIC PRESSURE BETWEEN THE FACEPLATE AND THE REARPLATE

BACKGROUND OF THE INVENTION

1. Field of the Invention

The present invention relates to a cathode ray tube, in which a plurality of regions of a phosphor screen, formed on the inner surface of a flat faceplate, are dividedly scanned with electron beams emitted from electron guns, and a method of manufacturing the same, and more particularly, to a cathode ray tube with an improved attachment structure for support members, which bear an atmospheric load acting on a flat faceplate and a flat rear plate, and a method of manufacturing the same.

2. Description of the Related Art

Recently, high-quality broadcasting and big-screen high-resolution cathode ray tubes have been examined in various ways. In general, the spot diameters of electron beams on a phosphor screen must be reduced in order to obtain high-resolution versions of cathode ray tubes.

Although attempts have conventionally been made to improve the electrode configuration of electron guns and increase the caliber, effective length, etc. of the electron guns themselves, satisfactory results have not been obtained yet. This is because if the tube size becomes larger, the distance from the electron guns to the phosphor screen is increased in proportion, so that the magnifications of electron lenses become too high. In order to obtain high-resolution tubes, therefore, it is essential to shorten the distance (depth) from the electron guns to the phosphor screen. For higher resolution, in this case, it is not advisable to use a wide-angle deflection system.

In response to this problem, the inventors hereof developed a big-screen high-resolution color cathode ray tube, which is described in U.S. Pat. No. 5,287,034. This cathode ray tube consists of a vacuum envelope formed of a flat faceplate and a flat rear plate, and a phosphor screen, consisting of stripe-shaped light absorbing layers and three-color phosphor layers arranged at predetermined intervals on the inner surface of the faceplate. Divided regions of the phosphor screen are separately scanned with electron beams that are emitted from electron guns, with the aid of a shadow mask. Divided images formed on the individual regions by the separate scanning are joined together without gaps or overlapping, whereupon a composite image is displayed on the phosphor screen. According to this color cathode ray tube, a plurality of support members are arranged between the faceplate and the rear plate in order to bear an atmospheric load that acts on the two flat plates.

In brief, the color cathode ray tube is manufactured in the following processes:

(a) a process for arranging mask setting members for supporting the shadow mask and the support members on the rear plate;

(b) a process for bonding side wall members, which constitute side walls between the faceplate and the rear plate, to the rear plate;

(c) a process for bonding the faceplate to the side walls that are attached to the rear plate;

(d) a process for bonding a plurality of funnels, each having an electron gun sealed therein, to a plurality of apertures in the rear plate, individually; and (e) a process for evacuating the envelope that is composed of the faceplate, side walls, rear plate, and funnels, bonded together.

Except for the arrangement of the support members, there is no substantial difference between this method for manufacturing the color cathode ray tube and a conventional manufacturing method as far as each divided region is concerned. Each support member used may be formed having a needle- or wedge-shape distal end portion, which abuts against the inner surface of the faceplate, or be in the form of a plain plate as a whole. The individual support members must be arranged so that their respective distal ends are located on those stripe-shaped light absorbing layers which are situated on the boundaries between the adjacent regions of the phosphor screen, lest the distal ends intercept the electron beams with which the divided regions are scanned separately. Accordingly, the distal end of each support member is expected to be as thin (in the horizontal direction) and long (in the vertical direction) as possible.

If the distal end of each support member is too thin, however, it may possibly be deformed or crushed by an atmospheric load that acts on the faceplate and the rear plate. If the distal end is too long, on the other hand, it cannot be easily located lest it be off its corresponding light absorbing layer.

Also, the support members require high accuracy in height. If they vary in height, deformation of the faceplate under the atmospheric load increases, so that the resistance to pressure lacks in reliability.

Conventionally, each of the support members of this type is constructed as an integral component that has the proximal end portion on the rear plate side and the distal end on the faceplate side. These support members are fixed to the rear plate in advance by using a high-precision positioning jig, and the rear plate, having the support members thereon, and the faceplate are then combined into an entire color cathode ray tube.

If the cathode ray tube is manufactured by the method described above, however, the support members may be tilted against the rear plate or inclined due to deformation of the rear plate or the like during manufacturing processes for the tube. When the rear plate and the faceplate are joined together, therefore, the respective distal ends of the support members cannot be accurately located on those light absorbing layers which are situated on the boundaries between the adjacent regions that are separately scanned with the electron beams. In this situation, the distal ends of the support members may possibly damage the phosphor screen or intercept the electron beams.

Owing to differences in inclination between the support members, moreover, the virtual lengths of the support members that are needed to support the faceplate vary. As a result, the deformation of the faceplate under the atmospheric load increases, so that the reliability of the resistance to pressure is lowered.

SUMMARY OF THE INVENTION

The present invention has been contrived in consideration of these circumstances, and its object is to provide a cathode ray tube, in which the height of support members for bearing an atmospheric load acting on a faceplate and a rear plate can be maintained with high accuracy, and the respective distal ends of the support members can be accurately located in predetermined positions with respect to a phosphor screen, and a method of manufacturing the same.

In order to achieve the above object, a cathode ray tube according to the present invention comprises: a vacuum envelope including a substantially rectangular flat faceplate and a substantially rectangular flat rear plate opposed to the faceplate; a phosphor screen formed on the inner surface of the faceplate; support means arranged between the faceplate and the rear plate and bearing atmospheric pressure acting on the faceplate and the rear plate; and a plurality of electron guns for emitting electron beams to the phosphor screen so that a plurality of regions of the phosphor screen are dividedly scanned with the electron beams. The support means includes a support member extending between the faceplate and the rear plate, the support member including a first support portion, set up on the rear plate and having a proximal end face intimately in contact with the inner surface of the rear plate and a bearing surface substantially parallel to the rear plate, and a second support portion, provided between the bearing surface of the first support portion and the inner surface of the faceplate in a manner such that the second support portion is located in a predetermined position with respect to the faceplate. The second support portion has a distal end abutting against a predetermined position on the inner surface of the faceplate and a proximal end portion intimately in contact with the bearing surface of the first support portion.

According to the cathode ray tube constructed in this manner, the support member for bearing the atmospheric load acting on the faceplate and the rear plate is divided into the first and second support portions, the second support portion being attached to the bearing surface of the first support portion so as to be intimately in contact therewith. If the support member is tilted against the rear plate or if the first support portion is inclined due to deformation of the rear plate or the like during the manufacture of the cathode ray tube, therefore, the distal end of the second support portion can be caused accurately to abut against a predetermined point on the inner surface of the faceplate by adjusting the position of the second support portion when the second support portion is attached to the first support portion.

Thus, the cathode ray tube can display high-quality images that are free from deterioration in quality, which may otherwise be caused when the electron beams for the separate scanning of the phosphor screen are intercepted by the distal end portions of the support member.

Also, the first support portion has a bearing surface parallel to the proximal end face that is intimately in contact with the inner surface of the rear plate, and the second support portion is fixed intimately in contact with the bearing surface. Even though the support member has a split structure, therefore, its height can be maintained with high accuracy, so that the cathode ray tube can enjoy a high-reliability construction without deterioration in the resistance to pressure.

In a color cathode ray tube of which the phosphor screen is formed of stripe-shaped light absorbing layers and stripe-shaped phosphor layers, in particular, the distal end of the second support portion can be accurately located on that light absorbing layer which is situated on the boundary between two adjacent regions of the phosphor screen.

A method according to the invention for manufacturing the aforementioned cathode ray tube comprises the steps of: fixing a first support portion of a support member to the rear plate so that the first support portion is set up on the inner surface of the rear plate substantially at right angles thereto in a manner such that the proximal end face of the first support portion is intimately in contact with the inner surface of the rear plate; positioning a second support portion of the support member with respect to the first support portion fixed to the rear plate, on the basis of the position of the faceplate positioned with respect to the rear plate; fixing the positioned second support portion to the first support portion corresponding thereto; and fixing the faceplate in a predetermined position with respect to the rear plate so that the distal end of the second support portion abuts against the inner surface of the faceplate.

An alternative manufacturing method according to the invention comprises the steps of: fixing a first support portion of each the support member to the rear plate so that the first support portion is set up on the inner surface of the rear plate substantially at right angles thereto in a manner such that the proximal end face of the first support portion is intimately in contact with the inner surface of the rear plate; positioning a second support portion of each support member with respect to the faceplate and attaching the second support portion to the faceplate with use of fixing means in a manner such that the distal end of the second support portion is in contact with the inner surface of the faceplate; and fixing the faceplate, having the second support portion attached thereto, in a predetermined position with respect to the rear plate, having the first support portion fixed thereto, so that each second support portion is held between the first support portion corresponding thereto and the inner surface of the faceplate.

According to the manufacturing method arranged in this manner, the first support portion is attached to the rear plate in advance, the faceplate is positioned with respect to the rear plate, and the second support portion is then positioned with respect to the positioned faceplate. By doing this, the second support portion can be located with high positional accuracy with respect to the faceplate without being substantially influenced by the arrangement accuracy of the first support portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 8 show a color cathode ray tube according to a first embodiment of the present invention, in which:

FIG. 1 is a perspective view of the color cathode ray tube,

FIG. 2 is a sectional view taken along line II—II of FIG. 1,

FIG. 3 is an exploded perspective view of the color cathode ray tube,

FIG. 5 is a perspective view showing part of a rear plate and a shadow mask of the color cathode ray tube, FIG. 6 is an exploded perspective view of a support member, FIG. 7 is a side view of the support member, and FIG. 8 is an exploded perspective view showing an assembly jig used for the manufacture of the color cathode ray tube, along with part of the tube;

DETAILED DESCRIPTION OF THE PREFERRED EMBODIMENTS

Color cathode ray tubes according to preferred embodiments of the present invention will now be described in detail with reference to the accompanying drawings.

Figure 1:
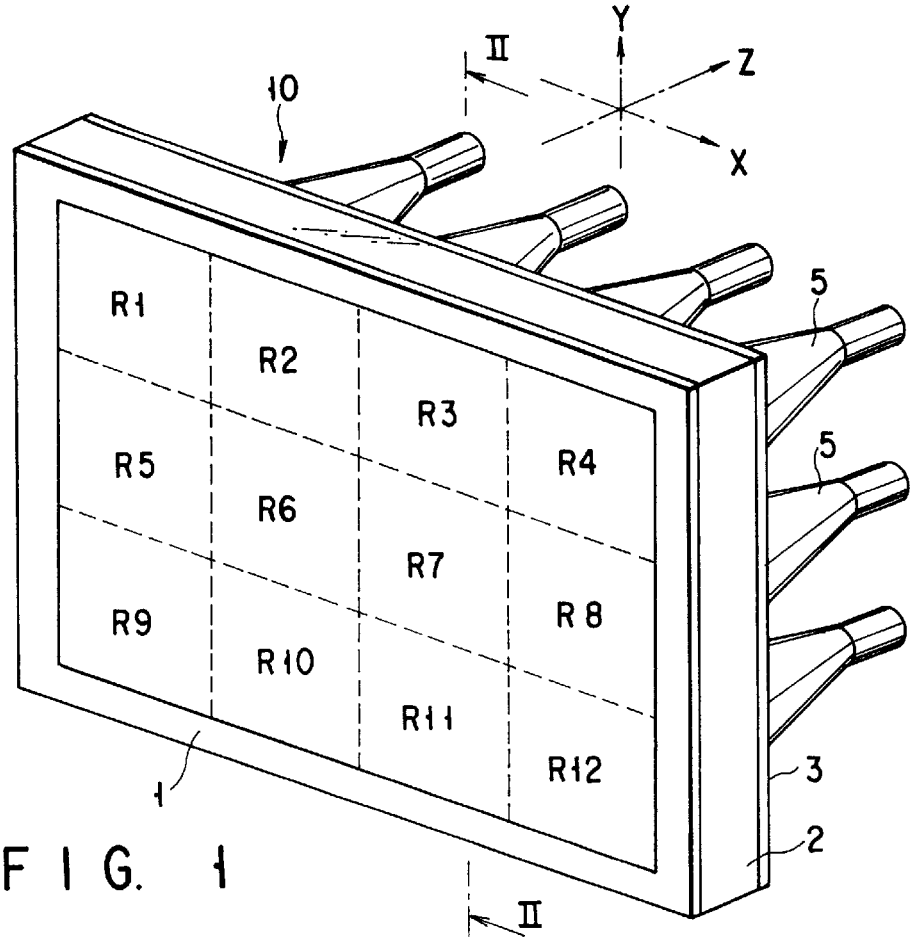
Figure 2:
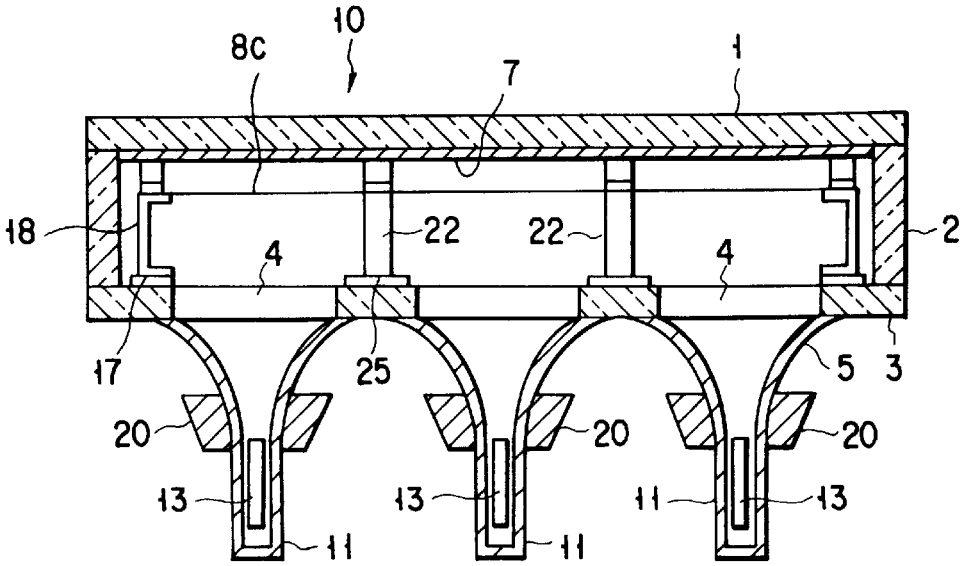
Figure 3:
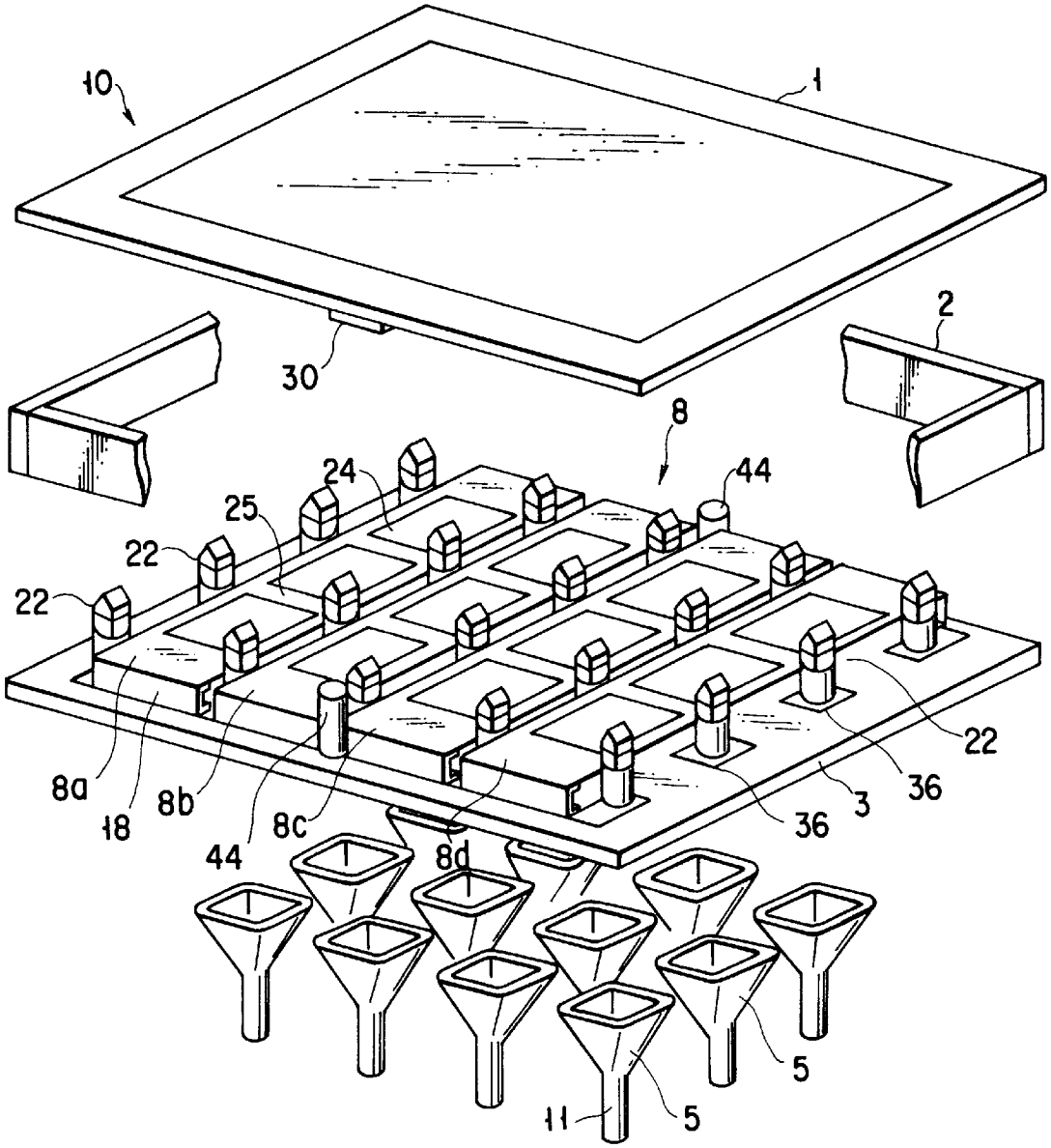

As shown in FIGS. 1 to 3, a color cathode ray tube according to a first embodiment of the invention comprises a vacuum envelope 10, which includes a faceplate 1, a side wall 2, a rear plate 3, and a plurality of glass funnels 5. The faceplate 1 is a substantially rectangular flat glass structure. The side wall 2 is a glass frame that is bonded to the peripheral portion of the faceplate 1 by means of frit glass and extends substantially perpendicular to the faceplate. The rear plate 3 is a substantially rectangular flat glass structure that is bonded to the side wall 2 by frit glass and opposed parallel to the faceplate 1. The funnels 5 are bonded to the rear plate 3 by frit glass so as to surround a plurality of apertures 4 in the rear plate, individually.

In the present embodiment, the rear plate 3 has twelve rectangular apertures 4 arranged in the form of a three-row, four-column matrix, and the funnels 5 are bonded to the rear plate so as to surround the apertures 4, individually. The row and column of the matrix extend in the horizontal (X-axis) and vertical (Y-axis) directions, respectively.

Figure 4A:
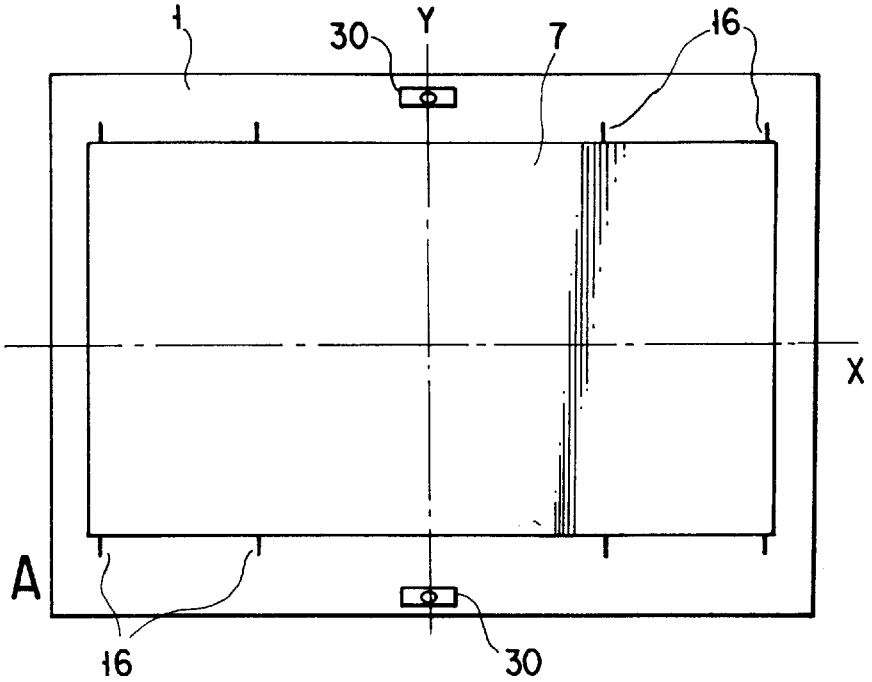
FIG. 4A is a plan view showing a faceplate of the color cathode ray tube.
Figure 4B:
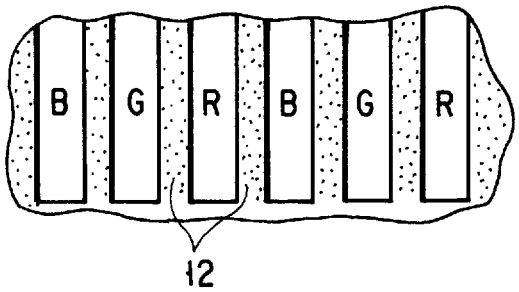
FIG. 4B is an enlarged plan view showing part of a phosphor screen formed on the faceplate.

As shown in FIGS. 4A and 4B, a generally rectangular phosphor screen 7 is formed on the inner surface of the faceplate 1. The phosphor screen 7 includes light absorbing layers 12 in the form of vertically elongated stripes and three-color phosphor layers B, G and R also in the form of stripes. The light absorbing layers 12 are arranged side by side at predetermined intervals in the horizontal direction, while the phosphor layers B, G and R are formed so as to fill up the intervals or gaps between the layers 12, and can emit blue, green, and red lights, respectively.

Moreover, four reference marks 16 are formed on each of two horizontal side edges of the phosphor screen 7. The marks 16 are in the form of a vertically extending line each, and are aligned with the light absorbing layers 12, individually. These reference marks 16 are used to position an assembly jig for assembling the color cathode ray tube with respect to the positioned faceplate 1, as mentioned later.

On the inner surface of the faceplate 1, moreover, an aligning plate 30 for positioning the rear plate 3 with respect to the faceplate 1 is fixed near the central portion of each horizontal side edge of the faceplate, and is situated outside the phosphor screen 7, as mentioned later. Each aligning plate 30 has a circular aperture.

Disposed in the vacuum envelope 10, as shown in FIGS. 2 and 3, is a shadow mask 8 that faces the phosphor screen 1. As mentioned later, the mask 8 is divided into four flat mask pieces 8*a* to 8*d*. In the envelope 10, moreover, a plurality of columnar support members 22 for bearing an atmospheric load acting on the faceplate 1 and the rear plate 3 are arranged between these plates 1 and 3.

An electron gun 13 for emitting electron beams toward the phosphor screen 7 is sealed in a neck 11 of each of the twelve funnels 5 that are joined to the rear plate 3. Also, a deflecting yoke 20 is wound around each neck 11.

In the color cathode ray tube constructed in this manner, three electron beams emitted from the electron guns 13 in the respective necks 11 of the twelve funnels 5 are deflected in the horizontal and vertical directions by magnetic fields that are generated by the deflecting yokes 20 outside the funnels. The phosphor screen 7 has twelve regions R1 to R12 in the form of a three-row, four-column matrix. The regions R1 to R12 are separately scanned with the deflected electron beams that are passed through the shadow mask 8. Divided images formed on the regions R1 to R12 are joined together without gaps or overlapping, whereupon a composite image is displayed on the phosphor screen 7.

Figure 5:
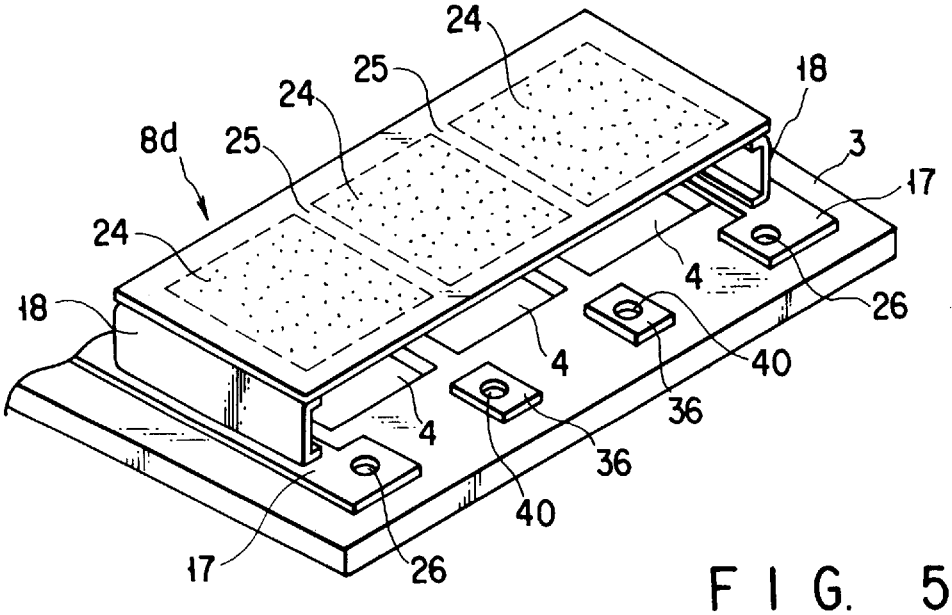

The shadow mask 8 is divided into the four mask pieces 8*a* to 8*d*, corresponding in number to the columns (horizontal divisions) of the regions R1 to R12. As shown in FIG. 5, each mask piece is in the form of a vertically elongated rectangular structure, and includes three rectangular effective regions 24 each having a large number of electron beam apertures and corresponding in number to the rows (vertical divisions) of the regions R1 to R12 of the phosphor screen 7. These effective regions 24 are connected to one another by means of bridge portions 25 that are not formed with any electron beam apertures.

Horizontally elongated fixed plates 17 are fixed individually to the vertically opposite end portions of the inner surface of the rear plate 3 by means of frit glass, and a plurality of mask setting members 18 are fixed on the plates 17. The respective opposite end portions of the mask pieces 8*a* to 8*d* are fixed to the setting members 18 under a vertical tension. Circular apertures 26 are formed individually in the opposite end portions of each fixed plate 17 and in positions between the adjacent mask pieces. A first support portion (mentioned later) of each support member 22 is adapted to be inserted in each corresponding aperture 26.

Figure 6:
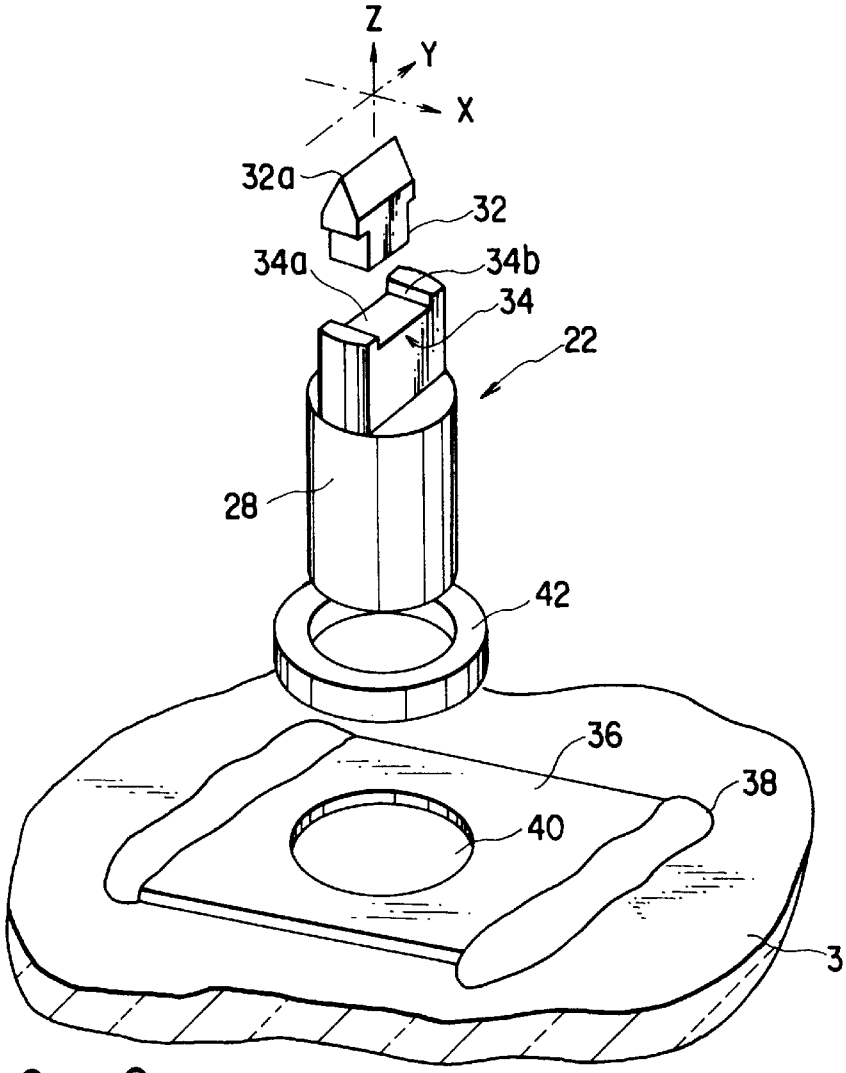

In the color cathode ray tube of the present embodiment, in particular, each support member 22, which bears the atmospheric load acting on the faceplate 1 and the rear plate 3, is divided in two, a first support portion 28 on the rear-plate side and a second support portion 32 on the faceplate side, as shown in FIG. 6. The first support portion 28 is substantially columnar in shape, and its lower end face constitutes a flat proximal end face 28*a* that is intimately in contact with the inner surface of the rear plate 3. The distal end portion of the first support portion 28 is formed having an engaging groove 34.

The engaging groove 34 is defined by a bottom face 34*a*, which extends parallel to the rear plate 3, and a pair of side walls 34*b*, which extend from the longitudinally opposite ends (in the Y-axis direction) of the bottom face 34*a* in a direction perpendicular to the bearing surface 34*a* and face each other in parallel relation in the transverse or X-axis direction. The bottom face 34*a* functions as a bearing surface for positioning the second support portion 32.

The second support portion 32 is in the form of an angular piece, and its distal end portion 32*a* is wedge-shaped. The length of the wedge-shaped end portion 32*a* is substantially equal to the diameter of the first support portion 28. The proximal end portion of the second support portion 32 is formed having a length substantially equal to the width or Y-direction length of the engaging groove 34 of the first support portion 28. The proximal end face of the portion 32 is flat. Also, the proximal end portion of the second support portion 32 engages the engaging groove 34 in a manner such that its proximal end face is intimately in contact with the bearing surface 34*a* of the groove 34. The second support portion 32 is restrained from moving in the Y-axis direction by the side walls 34*b* of the engaging groove 34, which serve as step portions, and its position is adjustable in the X-axis direction only.

Figure 7:
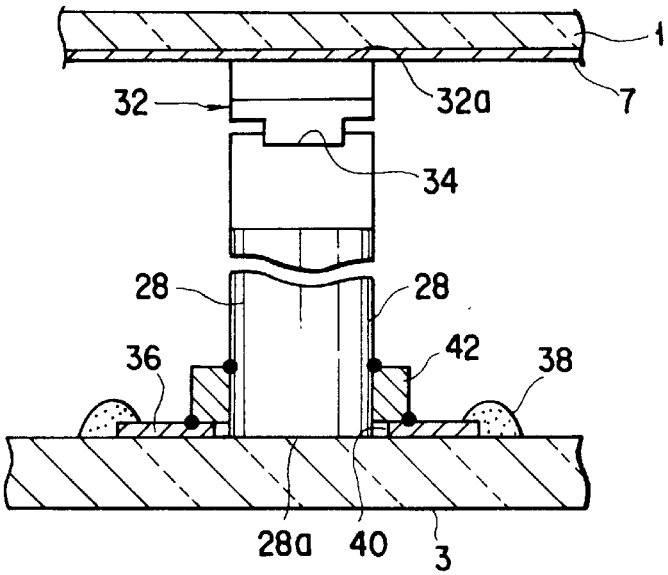
Figure 9:
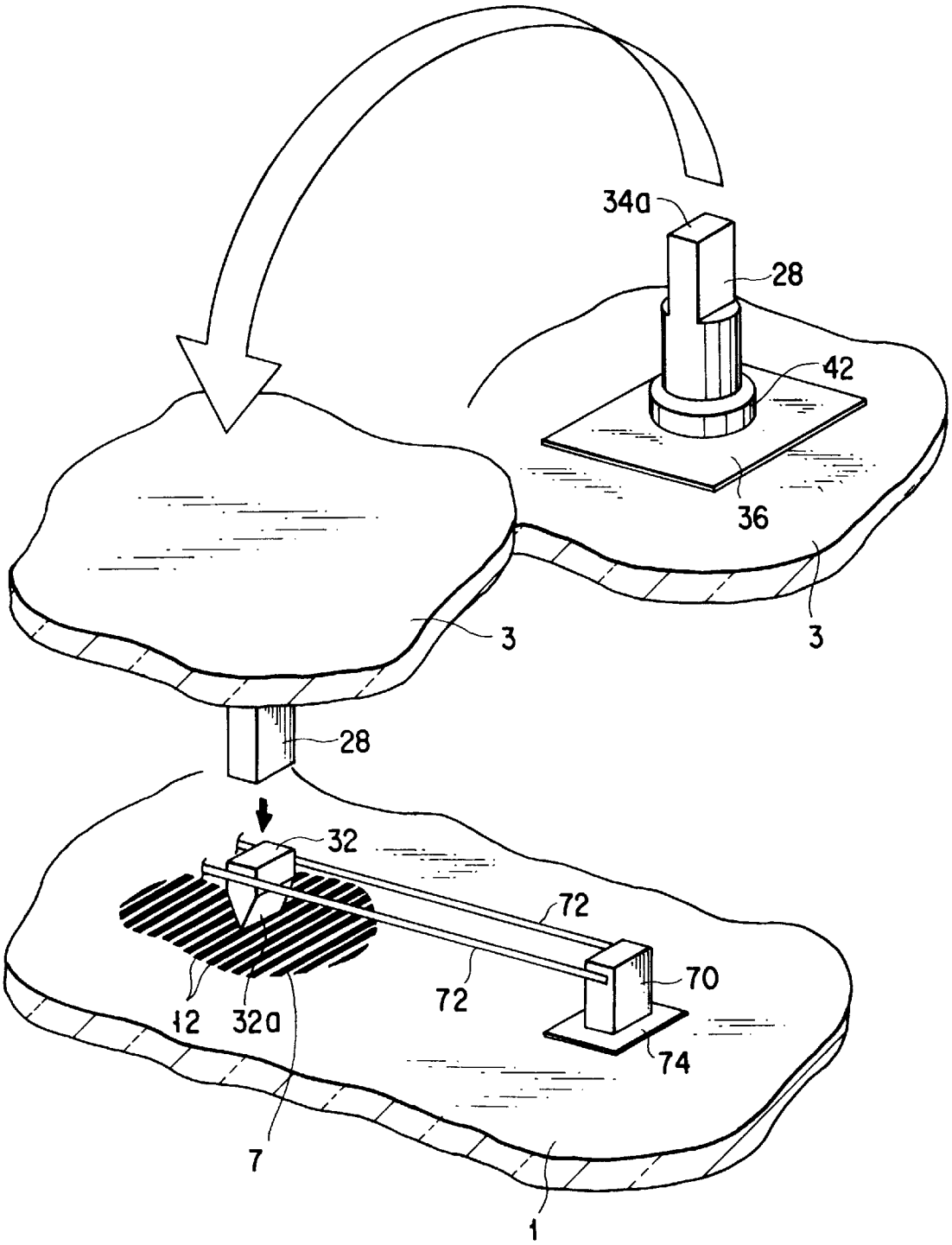
FIG. 9 is an exploded perspective view showing the principal part of a color cathode ray tube according to a second embodiment of the invention.

As shown in FIG. 9, the support members 22 are arranged so that their respective distal ends 32*a* abut against the boundaries between the regions of the phosphor screen 7 that are separately scanned with the electron beams. Fixed members 36, in the form of a rectangular plate each, are fixed on the inner surface of the rear plate 3, in positions opposite the boundaries between the horizontally adjacent regions of the phosphor screen 7 and near the horizontally opposite end edges of the screen 7, by means of frit glass 38. As shown in FIGS. 6 and 7, each fixed member 36 has a circular aperture 40, through which the proximal end portion of the first support portion 28 is passed. The frit glass 38 is located only on the opposite sides of each fixed member 36 lest it get into the aperture 40.

The first support portions 28 have their respective proximal end portions passed through the apertures 26 of the fixed plates 17, which are fixed to the vertically opposite end portions of the rear plate 3, or the apertures 40 of the fixed members 36, and the proximal end faces 28*a* are intimately in contact with the inner surface of the rear plate 3. Moreover, each first support portion 28 is inserted into its corresponding aperture 26 or 40 so that the side walls 34*b* of the engaging groove 34 extend parallel to the horizontal direction X. Further, a ring-shaped collar 42 is fitted on the proximal end portion of each first support portion 28, and is welded to the upper surface of the fixed plate 17 or the fixed member 36 and the outer peripheral surface of the first support portion 28. Thus, each first support portion 28 is set up on the inner surface of the rear plate 3 at right angles thereto, with its proximal end face 28*a* intimately in contact with the inner surface of the plate 3.

Each second support portion 32 is fitted in the engaging groove 34 of the first support portion 28 in a manner such that the longitudinal direction of the wedge-shaped distal end 32*a* is in line with the vertical direction Y and that the end 32*a* is in contact with its corresponding stripe-shaped light absorbing layer 12 that is situated on the boundary between two horizontally adjacent regions of the phosphor screen 7 or one of the horizontally opposite ends of the screen 7. Further, each second support portion 32 is welded to the two side walls 34*b* of the engaging groove 34 in a manner such that its proximal end face is intimately in contact with the bearing surface 34*a* of the engaging groove 34.

In the present embodiment, the support members 22 are arranged individually on the boundaries between the regions of the phosphor screen 7, which are separately scanned with the electron beams, and the horizontally opposite ends of the screen 7, and are twenty in total number, forming a four-row, five-column matrix.

The following is a description of a method for assembling the color cathode ray tube constructed in this manner.

For accurate assembly, the color cathode ray tube is provided with a pair of positioning means for correctly positioning the faceplate 1 and the rear plate 3 in a predetermined relation, besides the components described above, as shown in FIG. 3. The positioning means are arranged individually on the respective inner surfaces of the plates 1 and 3.

More specifically, a positioning post 44 is set up in the center of each of the vertically opposite end portions of the inner surface of the rear plate 3. On the other hand, the aligning plate 30 is fixed in the center of each of the vertically opposite end portions of the inner surface of the faceplate 1. Each aligning plate 30 has an aperture that can engage the distal end portion of its corresponding positioning post 44. The faceplate 1 and the rear plate 3 can be positioned with respect to each other by fitting the respective distal end portions of the two positioning posts 44 into the apertures of their corresponding aligning plates 30.

Figure 8:
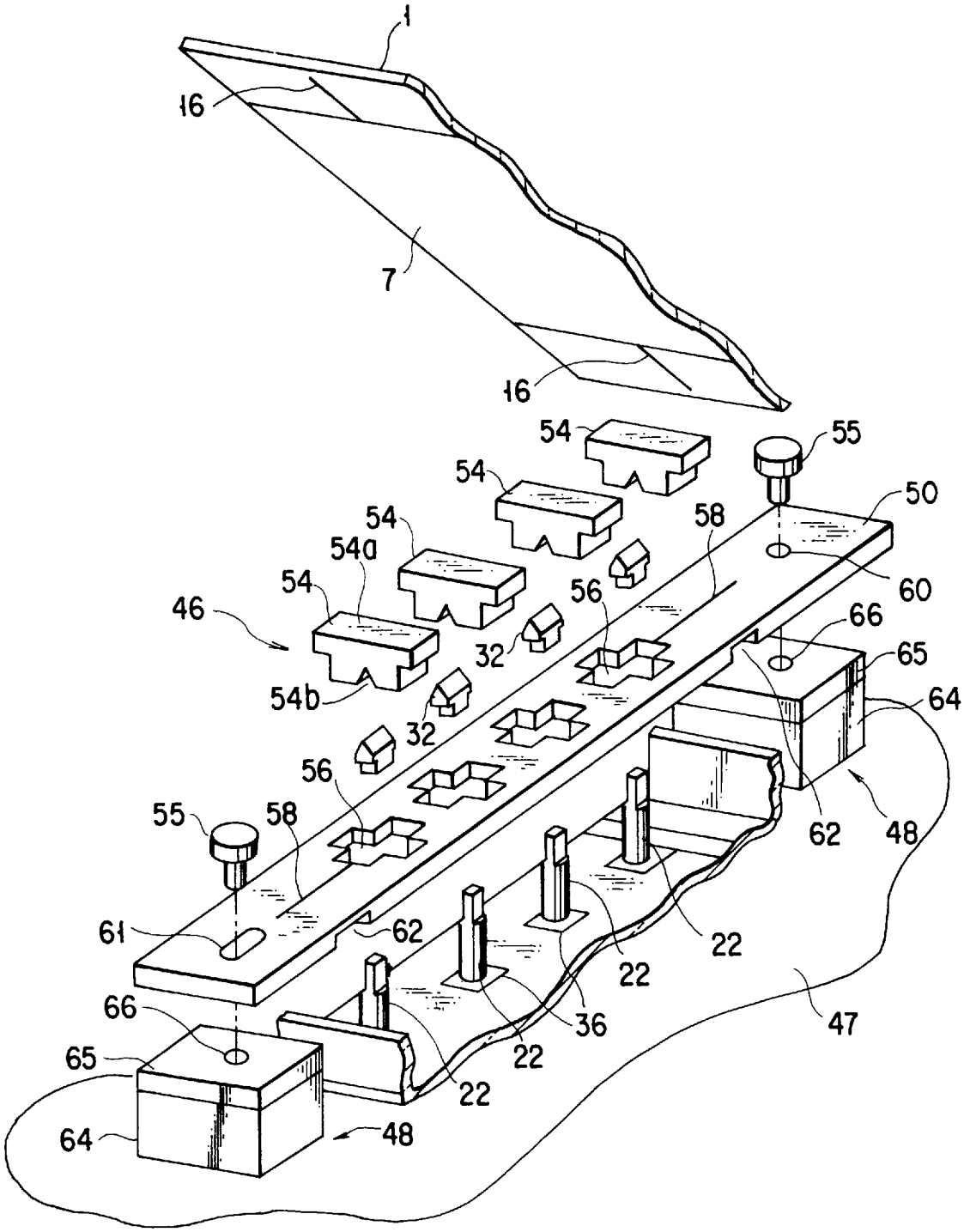

As shown in FIGS. 4A and 8, moreover, the inner surface of the faceplate 1 is formed having the reference marks 16 for positioning the assembly jig (mentioned later) in a predetermined relation with the faceplate 1, which is correctly positioned with respect to the rear plate 3, at the time of assembly. The reference marks 16 are previously formed together with the stripe-shaped light absorbing layers 12 of the phosphor screen 7, by photographic printing on the inner surface of the faceplate 1.

In assembly, the side wall 2, fixed plates 17, and fixed members 36 are first positioned with respect to the inner surface of the rear plate 3 by using an assembly jig (not shown), and are fixed to the inner surface of the plate 3 by using frit glass. Then, the mask setting members 18 are fixed to the fixed plates 17 by using an assembly jig (not shown), and the mask pieces 8*a* to 8*d* are attached to their corresponding setting members 18. Further, the respective first support portions 28 of the support members 22 are mounted on their corresponding fixed plates 17 and fixed members 36 in advance.

The faceplate 1, which is formed having the phosphor screen 7 and the reference marks 16, and the rear plate 3, which is fitted with the side wall 2, mask pieces 8*a* to 8*d*, first support portions 28, etc., are assembled by using an assembly jig 46 shown in FIG. 8.

The assembly jig 46 includes a bearer 47 for supporting the rear plate 3, a jig body 50 in the form of a vertically elongated plate, four locating jigs 54, a pair of adjusting mechanisms 48, and fixing pins 55. The jig body 50 is located on the rear plate 3, and is used to position the second support portions 32 with respect to their corresponding four first support portions 28 arranged in the Y-axis direction on the rear plate 3. The locating jigs 54 are adapted to engage the jig body 50, thereby individually locating the second support portions 32 with respect to their corresponding first support portions 28. The adjusting mechanisms 48 are provided on the bearer 47 so as to be situated on the opposite sides of the rear plate 3 with respect to the Y-axis direction, and individually support the vertically opposite end portions of the jig body 50. The mechanisms 48 serve for fine adjustment of the horizontal position of the jig body 50 with respect to the rear plate 3. The fixing pins 55 are used to fix the jig body 50 to the adjusting mechanisms 48.

The jig body 50 is formed having four cross-shaped apertures 56, which correspond individually to the four first support portions 28 on the rear plate 3, and are arranged at predetermined intervals on a straight line in the longitudinal direction of the jig body 50. Each aperture 56 is formed by combining two rectangular slots that extend in the horizontal and vertical directions, individually.

The jig body 50 is formed with linear reference marks 58, which are adapted to be aligned with the linear reference marks 16 on the faceplate 1. The marks 58 extend outward in the Y-axis direction from the cross-shaped apertures 56 at the opposite ends, individually.

Arranged at the opposite end portions of the jig body 50, moreover, are locating holes 60 and 61 for fixedly positioning the body 50 on the adjusting mechanisms 48. The one locating hole 60 is circular, while other locating hole 61 is formed in the shape of a slot having its major diameter in the Y-axis direction, in order to smooth the location of the jig body 50 by means of the adjusting mechanisms 48. That surface of the jig body 50 which faces the rear plate 3 is formed having grooves 62, whereby the jig body 50 can be prevented from coming into contact with the side walls 2 that are attached to the rear plate 3.

Each locating jig 54 includes a block-shaped body 54*a*, which engages the horizontal slot of its corresponding cross-shaped aperture 56. The body 54*a* is formed having a V-groove 54*b*, which engages the wedge-shaped distal end 32*a* of its corresponding second support portion 32. The V-groove 54*b* extends in the Y-axis direction.

Each adjusting mechanism 48 includes an adjusting base 64 and a slider 65 mounted on the base 64 for horizontal movement. The slider 65 is formed having a circular mounting hole 66, which corresponds in position to the locating hole 60 or 61. The jig body 50 can be mounted on the respective sliders 65 for the adjusting mechanisms 48 by inserting the fixing pins 55 into the circular holes 66 of their corresponding sliders 65 through the locating holes 60 and 61, individually.

In assembling the color cathode ray tube by using the assembly jig 46 described above, the rear plate 3, which is fitted with the side wall 2, mask pieces 8*a* to 8*d* (not shown in FIG. 4), first support portions 28 of the support members 22, etc., are first positioned on the bearer 47. The jig body 50 is put on the rear plate 3, and the fixing pins 55 are inserted individually into the circular holes 66 in the respective sliders 65 of the adjusting mechanisms 48 through the locating holes 60 and 61 at the opposite end portions of the jig body 50. In this manner, the jig body 50 is attached to the adjusting mechanisms 48.

Then, the faceplate 1 that has the phosphor screen 7 and the reference marks 16 therein is put on the jig body 50. In doing this, the positioning posts 44 on the rear plate 3 are fitted individually into the apertures of their corresponding aligning plates 30 on the face plate 1, whereupon the faceplate 1 is positioned with respect to the rear plate 3. In this case, a spacer (not shown) is interposed between the faceplate 1 and the side wall 2 on the rear plate 3 lest the upper surface of the jig body 50, which faces the faceplate 1, be in contact with the phosphor screen 7 on the inner surface of the faceplate 1.

Subsequently, the respective sliders 65 of the two adjusting mechanisms 48 are moved in the X-axis direction so that the linear reference marks 58 on the jig body 50 are aligned with the reference marks 16 on the positioned faceplate 1. Thereafter, the sliders 65 are fixed to their corresponding adjusting bases 64 by means of setscrews (not shown).

The one locating hole 61, out of the two holes 60 and 61 in the jig body 50, is in the form of a slot having its major diameter in the Y-axis direction. In adjusting the position of the jig body 50, therefore, changes of the distances between the fixing pins 55 and the circular holes 66, which may be caused by separately moving the respective sliders 65 of the two adjusting mechanisms 48, can be coped with, whereby the jig body 50 can be located smoothly.

Then, the faceplate 1 is removed, and the second support portions 32 are arranged individually on the bearing surfaces 34*a* at the distal ends of the four first support portions 28 that are attached to the rear plate 3. In this state, the respective bodies 54*a* of the locating jigs 54 are fitted individually into the respective horizontal slots of the cross-shaped apertures 56 in the jig body 50, and the respective distal ends 32*a* of the second support portions 32 are caused individually to engage the V-grooves 54*b* of the locating jigs 54. By doing this, the second support portions 32 are positioned on the respective bearing surfaces 34*a* of the first support portions 28, individually.

Then, a laser beam is applied to projections that constitute the side walls 34*b* of the engaging grooves 34 at the distal ends of the first support portions 28, through the respective vertical slots of the cross-shaped apertures 56, whereupon the positioned second support portions 32 are welded to the respective distal ends of their corresponding first support portions 28. Thereafter, the locating jigs 54 and the jig body 50 are removed.

Positioning and welding of the second support portions 32 with respect to the first support portions 28 are carried out for five columns (arranged in the horizontal direction) of support members 22, each column including four vertically arranged support members 22. Thereafter, the positioning posts 44 on the rear plate 3 are caused to engage the apertures in their corresponding aligning plates 30 on the faceplate 1, having the phosphor screen 7 thereon, and the faceplate 1 is bonded to the side wall 2, which is attached to the rear plate 3, by means of frit glass.

Subsequently, the vacuum envelope 10 is formed by bonding the twelve funnels 5, having their corresponding electron guns 13 previously sealed therein, to the rear plate 3 by means of frit glass, and the color cathode ray tube is completed by evacuating the envelope 10.

According to the color cathode ray tube constructed in this manner, each support member 22 is divided in two, first and second support portions 28 and 32. If any of the first support portions 28 is tilted when it is mounted on the rear plate 3, or if it is inclined due to deformation of the rear plate 3 or the like during the manufacture of the cathode ray tube, therefore, by adjusting the position of the second support portions 32 when the second support portions are attached to the first support portions 28, the respective distal ends 32*a* of the second support portions 32 can be accurately located on the stripe-shaped light absorbing layers 12 that are situated individually on the boundaries between the horizontally adjacent regions of the phosphor screen 7 on the inner surface of the faceplate 1. Moreover, the phosphor layers of the phosphor screen 7 cannot be damaged by the distal ends 32*a* of the support members 22.

Thus, there may be provided a color cathode ray tube capable of displaying a high-quality image without any deterioration in quality that may be caused if the distal ends 32*a* of the support members 22 are not situated on the boundaries between the horizontally adjacent regions and intercept the electron beams for separately scanning the phosphor screen 7.

The bearing surface 34*a* at the distal end of each first support portion 28 is formed so that the position of each corresponding second support portion 32 can be adjusted only in the X-axis direction or the width direction of the stripe-shaped light absorbing layers 12. Accordingly, the distal ends of the second support portions 32 can be located accurately and easily on the light absorbing layers that are situated on the boundaries between the horizontally adjacent regions.

Further, the bearing surface 34*a*, which extends parallel to the proximal end face 28*a* that is intimately in contact with the inner surface of the rear plate 3, is provided at the distal end of each first support portion 28, and each corresponding second support portion 32 is fixed tight to the bearing surface. Even though each support member has a split structure, therefore, its height can be maintained with high accuracy, so that the resulting color cathode ray tube can be a high-reliability product of which the resistance to atmospheric pressure never lowers.

Moreover, the respective distal ends 32*a* of the second support portions 32 can be accurately situated on the boundaries between the horizontally adjacent regions of the phosphor screen 7 by mounting the first support portions 28 on the rear plate 3 in advance, positioning the rear plate 3 with respect to the faceplate 1, and further positioning the assembly jig 46 with respect to the positioned faceplate.

In consideration of the influence of the deformation of the rear plate 3 or the like during the manufacture of the cathode ray tube, it is advisable to attach the second support portions 32 to the first support portions 28 in as late a process as possible. As described in connection with the foregoing embodiment, however, the influence of such deformation can be reduced by attaching the side wall 2 and the mask pieces 8*a* to 8*d* to the rear plate 3 in advance, and attaching the second support portions 32 to their corresponding first support portions 28 on the rear plate 3 before joining the two plates 1 and 3 together.

It is to be understood that the present invention is not limited to the embodiment described above, and that various changes and modifications may be effected therein by one skilled in the art without departing from the scope of the invention.

Although the second support portion of each support member according to the foregoing embodiment is wedge-shaped, for example, it may alternatively be plate-shaped or in any other shape. The number of the regions of the phosphor screen may be increased or decreased as required, and the number of the support members may be also varied depending on the number of the divided regions.

In the embodiment described above, the second support portions are attached individually to the first support portions in the five columns (arranged in the horizontal direction) by using one jig body for each four vertically arranged first support portions. Alternatively, however, the second support portions may be attached by using one jig body for all the first support portions on the rear plate.

Although the shadow mask 8 is mounted on the rear plate 3 according to the foregoing embodiment, it may alternatively be fixed to the inner surface of the faceplate 1. Further, the present invention is not limited to color cathode ray tubes, and may be also applied to monochromatic cathode ray tubes having no shadow mask, with the same result.

According to the present invention, the first support portions of the support members require high accuracy only in their height, and their required accuracy in arrangement is relatively low. Therefore, the first support portions can be attached to the rear plate with use of a relatively simple structure. More specifically, each first support portion must only be attached in a manner such that its proximal end face is intimately in contact with the inner surface of the rear plate, and is not limited to the attachment structure described in connection with the foregoing embodiment. Instead of fixing the proximal end of each first support portion in a manner such that it is inserted in the aperture in each corresponding fixed member, for example, fixed members may be arranged individually on the opposite sides of the proximal end of each first support portion so that the first support portion can be welded to the fixed members.

On the other hand, the second support portions of the support members require high arrangement accuracy, and the shorter their height, the less they can be influenced by dislocation.

According to the embodiment described above, the first support portion 28 of each support member 22 is mounted on the rear plate 3, and each corresponding second support portion 32 is fixed to the distal end of the first support portion after high-accuracy positioning. Alternatively, however, second support portions may be mounted on the inner surface of a faceplate 1 in the following manner.

According to a second embodiment shown in FIG. 9, as in the first embodiment mentioned before, a first support portion 28 of each support member 22 is welded to a fixed member 36, and its proximal end face 28*a* is intimately in contact with the inner surface of a rear plate 3. In this second embodiment, the distal end of each first support portion 28 is formed having a flat bearing surface 34*a* that extends parallel to the rear plate 3, and is not provided with an engaging groove 34.

On the other hand, a second support portion 32 of each support member 22 is mounted on the faceplate 1 by means of a fixed block 70 and stays 72. Four fixed members 74 are fixedly arranged side by side in the Y-axis direction (vertical direction) on each of the horizontally opposite end portions of the inner surface of the faceplate 1. One fixed block 70 is welded to each fixed member 74. Two belt-shaped stays 72 are stretched between each two fixed blocks 70 that face each other in the X-axis direction (horizontal direction).

Five second support portions 32 are fixed to each pair of stays 72, and are arranged at predetermined intervals in the X-axis direction. Each second support portion 32 is wedge-shaped, and is welded to the stays 72 in a manner such that its distal end 32*a* extends in the Y-axis direction and is located on a light absorbing layer 12 that is situated on the boundary between each two horizontally adjacent regions of a phosphor screen 7.

In positioning the second support portions 32, as in the case of the first embodiment, the second support portions 32 in each of columns arranged in the X-axis direction are positioned collectively with reference to reference marks 16 (see FIG. 4A) on the inner surface of the faceplate 1, and are fixed to the stays 72. Alternatively, the second support portions 32 may be fixed to the stays 72 after they are positioned with the stripe-shaped light absorbing layers 12 of the phosphor screen 7 observed, without the use of any reference marks.

After the first and second support portions 28 and 32 are thus fixed to the rear plate 3 and the faceplate 1, respectively, a side wall 2 is fixed to the rear plate 3, and the faceplate 1 is then fixed the side wall 2, in the same manner as in the foregoing embodiment, whereupon a vacuum envelope 10 is obtained. As a result, the bearing surface 34*a* of each first support portion 28 abuts against its corresponding second support portion 32 to be connected thereto. In this case, an atmospheric load acts on the rear plate 3 and the faceplate 1, thereby pressing the two plates toward each other. Thus, the first and second support portions 28 and 32 can be located in predetermined positions without being welded to one another, and never undergo dislocation.

For other arrangements, there is no difference between the first and second embodiments, so that like reference numerals are used to designate like portions throughout the drawings, and a detailed description of those portions is omitted.

According to the second embodiment constructed in the aforesaid manner, the second support portion 32 of each support member 22 is fixed to the faceplate 1, which has the phosphor screen 7 thereon, so that it can be located with respect to the screen 7 with very high accuracy. Also, the second support portion 32 can be located highly accurately in a predetermined position, since it cannot be easily influenced by the arrangement accuracy of its corresponding first support portion 28, especially a fall or deformation of the first support portion during heat treatment in the manufacturing processes.

In the second embodiment, the attachment structure for the second support portion 32 can be modified variously. For example, the stays 72 need not always be belt-shaped, and may alternatively be formed of members with a rectangular cross section, or may be arranged in the form of a matrix on the faceplate 1.

Figure 10:
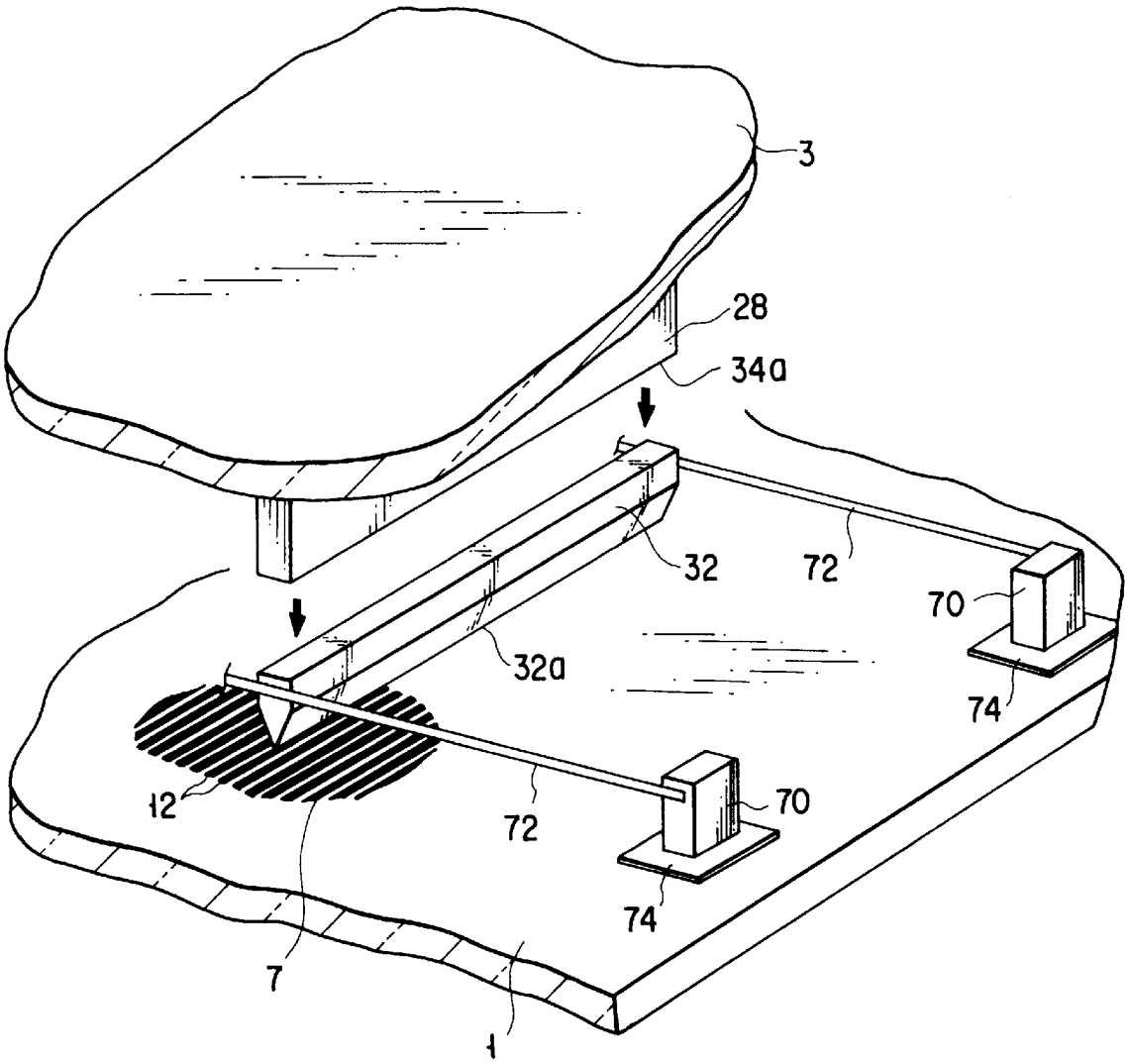
FIG. 10 is an exploded perspective view showing the principal part of a color cathode ray tube according to a third embodiment of the invention.

FIG. 10 shows a third embodiment of the present invention. According to this embodiment, a support member that is composed of a single first support portion 28 and a single second support portion 32, each in the form of an elongated plate, is used in place of a plurality of support members arranged in the Y-axis direction.

More specifically, the first support portion 28 of the support member 22 is fixed to a rear plate 3 and extends in the Y-axis direction, substantially covering the overall length of the rear plate 3 in the Y-axis direction. The first support portion 28, like the ones according to the foregoing embodiments, is welded to a fixed member (not shown) that is fixed to the inner surface of the rear plate 3, and its proximal end surface is intimately in contact with the inner surface of the rear plate 3. Moreover, the distal end of the first support portion 28 is formed having a bearing surface 34*a* that extends parallel to the rear plate 3.

Likewise, the second support portion 32, which is in the form of an elongated plate extending in the Y-axis direction, is mounted on a faceplate 1 by means of fixed blocks 70 and stays 72. More specifically, four fixed members 74 are fixed individually in the four corners of the inner surface of the faceplate 1, and the fixed blocks 70 are welded individually to the fixed members 74. Each belt-shaped stay 72 is stretched between its corresponding two fixed blocks 70 that face each other in the X-axis direction (horizontal direction).

The vertically opposite end portions of the second support portion 32 are welded individually to the stays 72. The second support portion 32 has its distal end portion wedge-shaped, and is fixed to the stays 72 so that its distal end 32*a* extends in the X-axis direction and is located on a light absorbing layer 12, which is situated on the boundary between each two horizontally adjacent regions of a phosphor screen 7. The second support portions 32 are positioned in the same manner as the ones according to the second embodiment.

Also in the third embodiment constructed in this manner, the second support portion 32 of the support member 22 is fixed to the faceplate 1, which has the phosphor screen 7 thereon, so that it can be located with respect to the screen 7 with very high accuracy. Also, the second support portion 32 can be located highly accurately in a predetermined position, since it cannot be easily influenced by the arrangement accuracy of the first support portion 28, especially a fall or deformation of the first support portion during heat treatment in the manufacturing processes.

According to the third embodiment, moreover, the use of the elongated first support portions 28, which extend substantially covering the overall length of the rear plate 3 in the Y-axis direction, ensures a reduction in number of the first support portions and dispersion of an atmospheric load that acts on the rear plate 3. Thus, the atmospheric load can be securely prevented from being concentrated locally, and therefore, from damaging the rear plate 3.

With use of the second support portions 32 that extend long in the Y-axis direction, furthermore, the second support portions can be reduced in number, and the atmospheric load can be dispersed.

Figure 11:
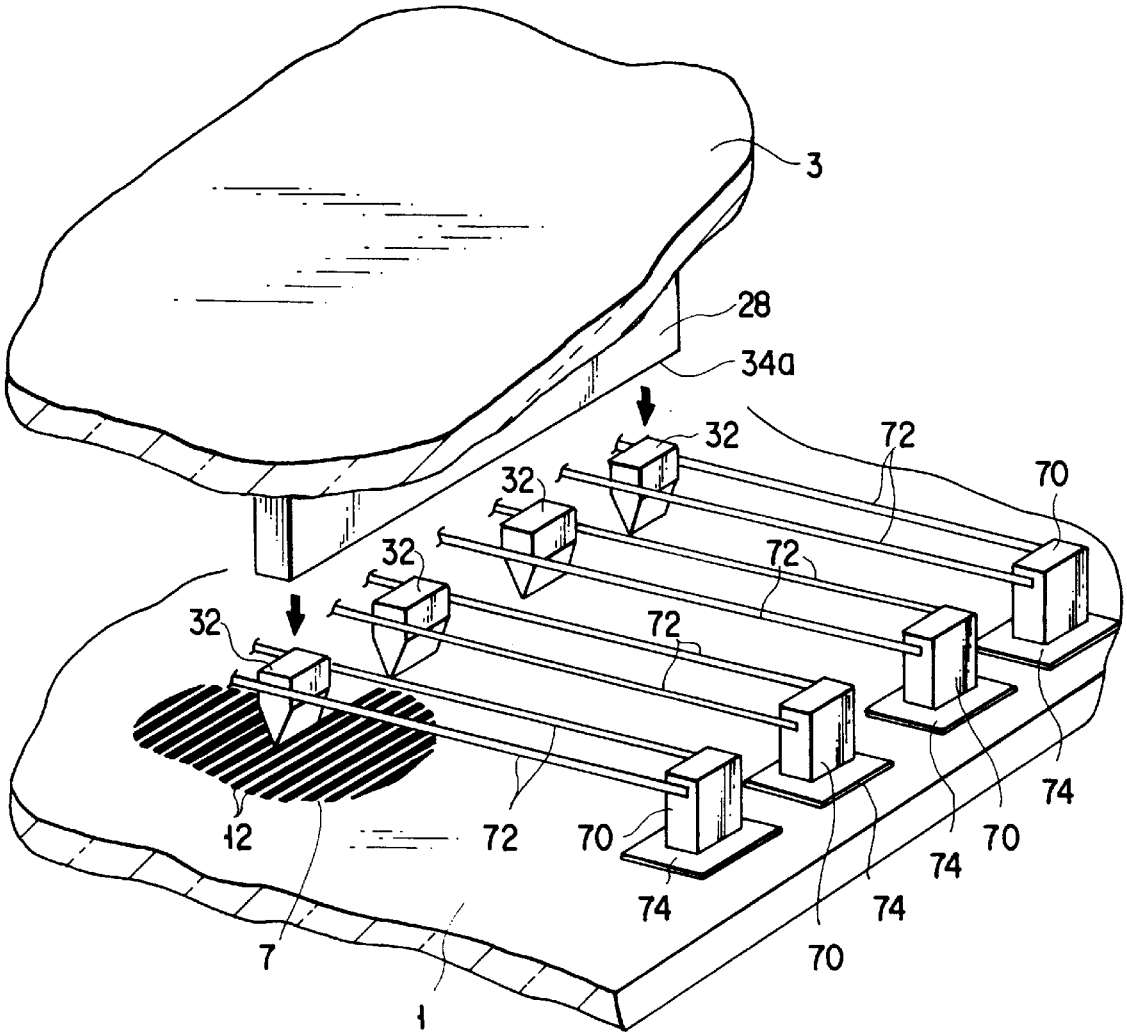
FIG. 11 is an exploded perspective view showing the principal part of a color cathode ray tube according to a fourth embodiment of the invention.

As in a fourth embodiment of the present invention shown in FIG. 11, moreover, a support member 22 may be formed by combining an elongated first support portion 28, which extends long in the Y-axis direction, and a plurality of second support portion 32, each in the formed of an angular piece. In this case, as in the case of the second embodiment, four fixed members 74 are fixedly arranged side by side in the Y-axis direction (vertical direction) on each of the horizontally opposite end portions of the inner surface of the faceplate 1. One fixed block 70 is welded to each fixed member 74. Two belt-shaped stays 72 are stretched between each two fixed blocks 70 that face each other in the X-axis direction (horizontal direction).

Five second support portions 32 are fixed to each pair of stays 72, and are arranged at predetermined intervals in the X-axis direction. Each second support portion 32 is wedge-shaped, and is welded to the stays 72 in a manner such that its distal end 32*a* extends in the Y-axis direction and is located on a light absorbing layer 12 that is situated on the boundary between each two horizontally adjacent regions of a phosphor screen 7. Each four second support portions 32 arranged in the Y-axis direction are connected to their corresponding elongated first support portion 28, thus forming a support member.

The fourth embodiment constructed in this manner can provide the same functions and effects of the second and third embodiments.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A cathode ray tube comprising:

a vacuum envelope including a substantially rectangular flat faceplate and a substantially rectangular flat rear plate opposed to the faceplate;

a phosphor screen formed on an inner surface of the faceplate;

support elements located between the faceplate and the rear plate and bearing atmospheric pressure acting on the faceplate and the rear plate; and a plurality of electron guns for emitting electron beams to a plurality of corresponding regions of the phosphor screen such that each electron gun scans the corresponding phosphor screen region;

the support elements including at least one support member extending between the faceplate and the rear plate, the support member including a first support portion, affixed to the rear plate and having a proximal end face intimately in contact with the inner surface of the rear plate and a bearing surface substantially parallel to the rear plate, and a second portion, provided between the bearing surface of the first support portion and the inner surface of the faceplate in a manner such that the second support portion is located in a predetermined position with respect to the faceplate, the second support portion having a distal end abutting against a predetermined position on the phosphor screen and a proximal end portion intimately in contact with the bearing surface of the first portion.

2. A cathode ray tube according to claim 1, which further comprises a fixed member fixed to the inner surface of the rear plate, and wherein said first support portion is fixed to the fixed member in a manner such that the proximal end face of the first support portion is intimately in contact with the inner surface of the rear plate.

3. A cathode ray tube according to claim 2, wherein said fixed member has an aperture, and said proximal end face of the first support portion is intimately in contact with the inner surface of the rear plate through the aperture.

4. A cathode ray tube according to claim 1, wherein said second support portion is fixed to the first support portion in a manner such that the second support portion is located in a predetermined position with respect to the faceplate.

5. A cathode ray tube according to claim 1, wherein said support elements include means for fixing the second support portion to the faceplate.

6. A cathode ray tube according to claim 5, wherein said fixing means includes a fixed portion fixed to the inner surface of the faceplate and a connecting member connecting the second support portion to the fixed portion.

7. A cathode ray tube according to claim 1, wherein said support member includes a plurality of said second support portions arranged side by side, each of the second support portions having a distal end abutting against a predetermined position on the inner surface of the faceplate and a proximal end portion intimately in contact with the bearing surface of the first support portion.

8. A cathode ray tube according to claim 1, wherein said faceplate has first and second axes extending parallel to the inner surface of the faceplate and at right angles to each other;

said phosphor screen includes a large number of stripe-shaped light absorbing layers, extending parallel to the first axis and arranged at intervals in the direction of the second axis, and stripe-shaped phosphor layers formed between the adjacent light absorbing layers and extending in the direction of the first axis; and said second support portion is positioned so that the distal end thereof is situated on one of the light absorbing layers.

9. A cathode ray tube according to claim 8, wherein said bearing surface of the first support portion includes a step portion for allowing the second support portion to move in the direction of the second axis and restraining the second support portion from moving in the direction of the first axis.

10. A cathode ray tube according to claim 8, which further comprises a shadow mask disposed in the vacuum envelope so as to face the phosphor screen.

11. A cathode ray tube according to claim 1, wherein the length of the first support portion in the direction perpendicular to the inner surface of the rear plate is greater than the length of the second support portion.

12. A cathode ray tube according to claim 1, wherein said support means includes a plurality of said support members arranged so that the distal end of each second support portion thereof abuts against the boundary between two adjacent regions of the phosphor screen.

13. A method for manufacturing a cathode ray tube, which comprises a vacuum envelope including a substantially rectangular flat faceplate and a substantially rectangular flat rear plate opposed to the faceplate, a phosphor screen formed on an inner surface of the faceplate, a plurality of support members located between the faceplate and the rear plate and bearing atmospheric pressure acting on the faceplate and the rear plate, and a plurality of electron guns for emitting electron beams to the phosphor screen so that a plurality of regions of the phosphor screen are dividedly scanned with the electron beams, the method comprising the steps of:

fixing a first support portion of each of the support members to the rear plate so that the first support portion is set up on the inner surface of the rear plate substantially at right angles thereto in a manner such that a proximal end face of the first support portion is intimately in contact with the inner surface of the rear plate;

positioning a second support portion of each of the support members with respect to the first support portion fixed to the rear plate, on the basis of the position of the faceplate positioned with respect to the rear plate;

fixing the positioned second support portion to the first support portion corresponding thereto; and fixing the faceplate in a predetermined position with respect to the rear plate so that the distal end of the second support portion abuts against the inner surface of the faceplate.

14. A method for manufacturing a cathode ray tube, which comprises a vacuum envelope including a substantially flat faceplate and a substantially rectangular rear plate opposed to the faceplate, a phosphor screen formed on an inner surface of the faceplate, support elements located between the faceplate and the rear plate and bearing atmospheric pressure acting on the faceplate and the rear plate, and a plurality of electron guns for emitting electron beams to a plurality of corresponding regions of the phosphor screen such that each electron gun scans the corresponding phosphor screen region, the method comprising the steps of:

fixing a first support portion of each of the support members to the rear plate so that the first support portion is set up on the inner surface of the rear plate substantially at right angles thereto in a manner such that a proximal end face of the first support portion is intimately in contact with the inner surface of the rear plate;

positioning a second support portion of each of the support members with respect to the faceplate and attaching the second support portion to the faceplate with use of fixing means in a manner such that the distal end of the second support portion is in contact with the inner surface of the faceplate; and fixing the faceplate, having the second support portion attached thereto, in a predetermined position with respect to the rear plate, having the first support portion fixed thereto, so that each said second support portion is held between the first support portion corresponding thereto and the inner surface of the faceplate.

* * * * *